United States Patent [19]

Ogura

[11] 4,249,658

[45] Feb. 10, 1981

[54] CASE FOR A TAPE

[76] Inventor: Kiyoshi Ogura, 1-7-203, Takeshirodai 2-cho, Sakai-shi, Osaka-fu, Japan

[21] Appl. No.: 56,248

[22] Filed: Jul. 10, 1979

[30] Foreign Application Priority Data

Jul. 12, 1978 [JP] Japan ..... 53-96674[U]
Sep. 13, 1978 [JP] Japan ..... 53-127761[U]

[51] Int. Cl.[3] ..... B65D 85/67
[52] U.S. Cl. ..... 206/409; 206/461; 242/1
[58] Field of Search ..... 206/409, 241, 389, 461; 221/70; 52/108; 242/54 A, 1; 15/231, 236

[56] References Cited

U.S. PATENT DOCUMENTS

| | | | |
|---|---|---|---|
| 2,410,420 | 11/1946 | Bennett | 15/231 |
| 3,246,814 | 4/1966 | Lovell et al. | 206/409 |
| 3,743,086 | 7/1973 | Aldrich | 206/409 |
| 3,754,643 | 8/1973 | Foster | 206/409 |

*Primary Examiner*—William T. Dixson, Jr.
*Attorney, Agent, or Firm*—Thomas E. Schatzel

[57] ABSTRACT

A case for a tape, particularly for a bias tape, including a cover and a base plate adhered to the cover. An integral guide extending tangentially from the case has a top wall tapering toward its outlet so that the bias tape will be folded down the middle as it is pulled out of the case.

5 Claims, 6 Drawing Figures

CASE FOR A TAPE

The present invention relates to a case for a tape, and more particularly to a case for a bias tape.

Conventionally, a bias tape has been sold wound around a plate or panel made of wood or other material. The bias tape furnished in this form accompanies some difficulties in using it to hem a cloth, for example. One disadvantage is that folds are left at regular intervals on the bias tape unwound from the panel. Further, in using the bias tape to hem the edge of a cloth with a sewing machine, the bias tape had to be folded down longitudinally once or twice. This work had to be done by hand and was very troublesome.

It is an object of the present invention is to provide a case for a tape which contains or stores the tape in such a manner as not to leave folds on the tape.

It is another object of the present invention to provide a case for a tape which can automatically fold down the tape longitudinally when it is pulled out of the case.

It is a further object of the present invention to provide a case for a tape which permits smooth work in using it to hem a cloth by machine.

Other features and advantages of the present invention will become apparent from the following description taken with reference to the accompanying drawings, in which.

Like numerals are used to designate like or corresponding parts.

Figure 1:
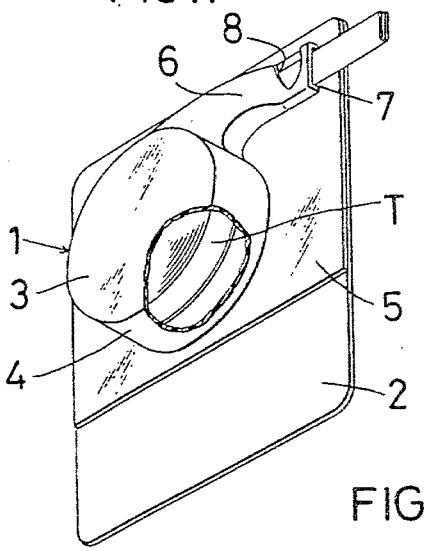
FIG. 1 is a partially cutaway perspective view of the first embodiment of this invention.
Figure 2:
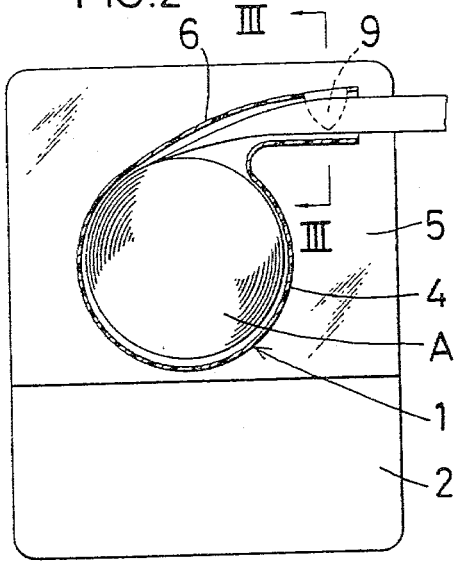
FIG. 2 is a horizontal sectional view thereof.
Figure 3:
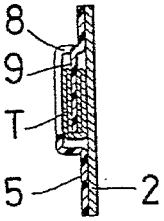
FIG. 3 is a sectional view taken along the III—III of FIG. 2.

Referring to FIGS. 1—3 illustrating the first embodiment, the case according to this invention comprises a cover generally designated by numeral 1 and a base plate 2. The roll enclosing portion of the cover 1 consists generally of a top wall 3, a cylindrical side wall 4, and a base portion 5. The cover 1 is fastened or adhered to the base plate 2 made of cardboard, for example, to enclose a bias tape T therein. The cover 1 is preferably molded of a transparent synthetic resin so that it can be seen from outside how much tape is left.

The cover 1 is also provided with a guide 6 formed integrally so as to extend substantially tangentially from the side wall 4 of the cover and provide the passage for the tape. The guide has a top wall tapering toward its outlet 7 which has a height just enough to pass the folded tape and a width substantially half of that of the tape. The tape T is pulled out of the case through the guide 6 from the outlet 7.

The guide 6 has a V-shaped cut 8 adjacent to the outlet 7 in its top wall and part of its outer side wall. The V-shaped portion thus cut is pushed into the passage of the tape to form a tongue 9, as shown in FIG. 3. This tongue may be formed in any other suitable manner.

The bias tape T is contained in the case in roll usually with its edges folded down longitudinally so as to face each other on its outer side. The bias tape in this case is furnished with its end projecting slightly from the outlet 7. When pulled out of the case, the bias tape is guided through the guide 6. As it passes therethrough, it is further folded longitudinally down the middle since the guide has a top wall tapering toward its outlet 7. The tongue 9 serves to help or guide the folding of the tape. However, it may be omitted.

It will be understood from the foregoing that the bias tape T comes from the outlet in a folded shape for immediate use to hem the cloth. This completely eliminates manual folding work that was required before.

Figure 6:
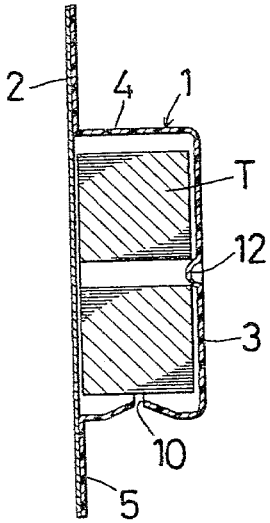
FIG. 6 is a vertical sectional side view taken along the line VI—VI of FIG. 5.
Figure 4:
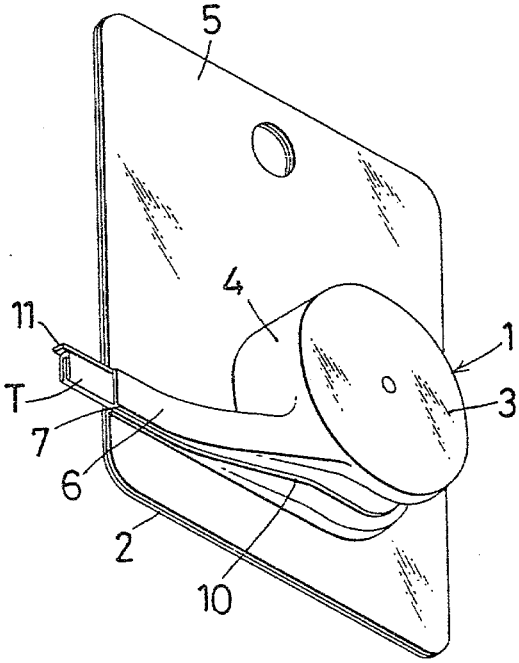
FIG. 4 is a perspective view of the second embodiment.
Figure 5:
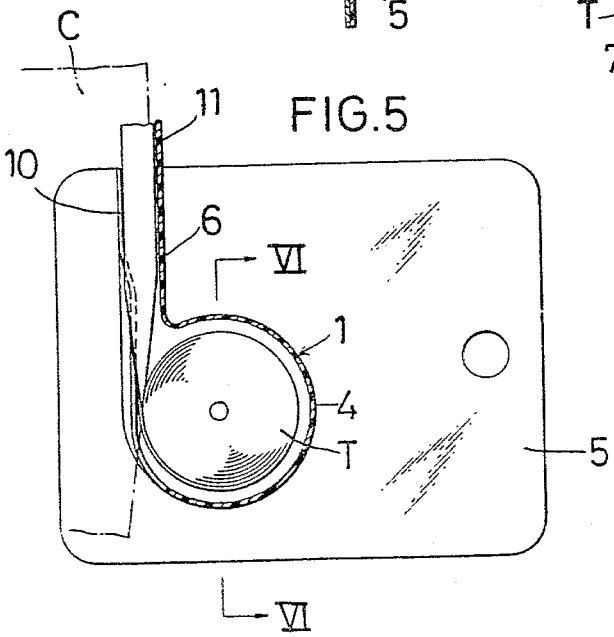
FIG. 5 is a horizontal sectional view thereof.

Referring to FIGS. 4–6, there is illustrated the second embodiment of the present invention. Like the first embodiment, the case comprises a cover 1 and a base plate 2, said cover including a top wall 3, a cylindrical side wall 4, a base portion 5, and a guide 6 tapering toward the outlet 7. The guide is of substantially the same shape as in the first embodiment.

In this embodiment, the tongue formed in the first embodiment is omitted. A slit 10 is formed longitudinally in the outer side wall of the guide and in part of the side wall 4 of the cover 1 so as to extend to the outlet 7.

At the inner side of the outlet 7 is provided an extension 11 so as to project from the outlet to serve as a guide. The top wall 3 of the cover 1 is provided with a downward projection 12 in its center so as to fit in the center hole of the tape roll to serve as a guide for the rotation of the tape roll.

When pulled, the bias tape T contained in roll in the case comes from the outlet 7 folded down the middle for immediate use. Since it tapers toward the outlet, the guide 6 forces the bias tape to be folded down the middle as it passes through the guide.

In using the bias tape to hem a cloth by machine, the end of the tape is pulled from the outlet 7 of the guide with the cloth to be hemmed inserted into the slit 10 between the folded edges of the bias tape T. By sewing together the bias tape and the cloth by machine while pulling out the bias tape, the cloth can be easily and continuously hemmed without the necessity of manually folding the bias tape and putting on the edge of the cloth before sewing.

Although this invention has been described with reference to the preferred embodiments, it is to be understood that various changes or modifications may be made within the scope of this invention.

What are claimed are:

1. A case to enclose a rolled length of foldable tape comprising:

a base plate, and an integral cover fastened to the base plate, the cover having a roll enclosing portion comprising a top wall, a cylindrically shaped side wall and a guide through which tape may be pulled, said guide extending substantially tangentially from said side wall of said roll enclosing portion, the top wall of said guide being tapered from the point at which said guide attaches to said roll enclosing portion toward the outlet of said guide, whereby as the tape passes through said guide the tape is folded longitudinally.

2. A case as claimed in claim 1, further comprising:

a tongue means projecting from the side wall of said guide and located adjacent to the outlet of said guide to help fold the tape longitudinally as the tape passes through said guide.

3. A case as claimed in claim 1, further comprising:

a slit formed longitudinally in the side wall of said guide extending to the outlet of said guide.

4. A case as claimed in claim 1, wherein the height of the outlet of said guide is approximately equal to the thickness of the folded tape and the width of the outlet of said guide is approximately equal to one-half the width of the tape.

5. A case as claimed in claim 1, further comprising a downward projection means in the center of said top wall of said roll enclosing portion of the cover for guiding the rotation of the tape roll.

* * * * *